United States Patent [19]

Jamieson et al.

[11] Patent Number: 5,029,855

[45] Date of Patent: Jul. 9, 1991

[54] GOLF TEE MARKER AND RECEPTACLE

[76] Inventors: William A. Jamieson, 875 Bonde Ct.; C. Jack Mehan, 5336 Brookside Ct.; Denise A. Howe, 3228 Arbor Dr., all of Pleasanton, Calif. 94566

[21] Appl. No.: 533,936

[22] Filed: Jun. 5, 1990

Related U.S. Application Data

[63] Continuation of Ser. No. 414,718, Sep. 29, 1989, abandoned.

[51] Int. Cl.[5] ..... A63B 57/00

[52] U.S. Cl. ..... 273/32 B

[58] Field of Search ..... 273/33, 32 A, 32 B, 273/32 D, 182 R, 181 A, 181 R, 176 F, 176 B; 248/94, 95, 100, 907, 97, 99, 188; 47/66, 39, 41.01, 41.12, 41.14, 41.15

[56] References Cited

U.S. PATENT DOCUMENTS

| | | | |
|---|---|---|---|
| 1,129,013 | 2/1915 | Reach | 273/32 G |
| 1,538,537 | 5/1925 | Wood | 273/32 G |
| 1,587,295 | 6/1926 | Gammeter | 273/33 |
| 1,639,765 | 8/1927 | Fisher | 273/32 G |
| 2,482,278 | 9/1949 | Koerner | 248/907 |
| 2,936,179 | 5/1960 | Thurston | 273/176 B |
| 3,028,134 | 4/1962 | Nolen | 248/907 |
| 3,415,518 | 12/1968 | Root | 273/32 A |
| 4,069,954 | 1/1978 | Rauch | 273/32 A |
| 4,129,237 | 12/1978 | Grinder | 273/32 A |
| 4,151,937 | 5/1979 | Jarosh et al. | 273/32 A |
| 4,162,071 | 7/1979 | Fish et al. | 273/33 |
| 4,336,939 | 6/1982 | Krumlauf | 273/182 R |
| 4,736,877 | 4/1988 | Clark | 273/32 A |
| 4,850,483 | 7/1989 | Stack | 273/32 A |

*Primary Examiner*—Theatrice Brown
*Attorney, Agent, or Firm*—Bruce & McCoy

[57] ABSTRACT

A golf tee holder and marker accessory to be placed at the teeing area for holding broken tees and for indicating a golfer's position relative to a distant flag placed at a "green" on a golf. The accessory includes a block member having rectangular sides and a substantially square cross section. A cone shaped aperture extends along the longitudinal axis of the block member. A pair of ground engaging spikes are attached to the bottom end of the block member for easy removal and attachment of the block member to the ground surface. Three sides of the block member is provided with indicia which, when the block is placed at a predetermined position, will indicate to a golfer the relative position of a distant flag to the green, i.e. if the flag is in front, at the rear or in the middle of the green.

4 Claims, 1 Drawing Sheet

GOLF TEE MARKER AND RECEPTACLE

Figures 1, 2, 3:
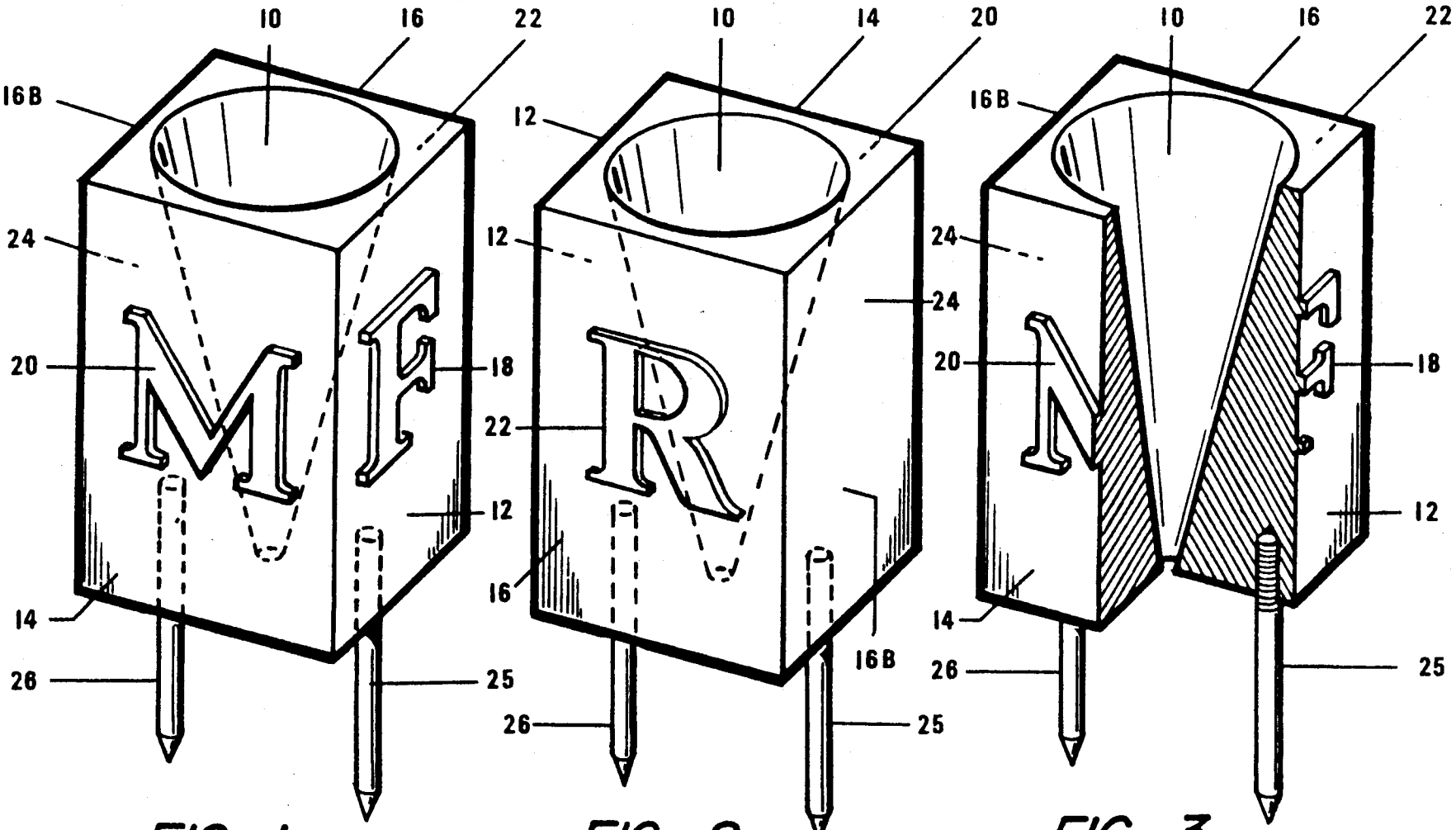

This is a continuation of copending application Ser. No. 07/414,718 filed on Sept. 29, 1989 (abandoned).

BACKGROUND

1. Field of Invention

This invention relates to the game of golf, specifically to a multi-purpose device that defines the teeing areas on a golf tee and shows the location of the flag on the green and provides a receptacle for broken tees.

2. Discussion of Prior Art

This invention is new and, in our patent search, there were no listings or evidence of a like or similar product. Our exhaustive patent research indicates there is no prior art that fulfills all the functions of our invention.

One use of our multi-use invention, marking golf teeing areas, has prior art. Markers for this purpose are made from metal, wood or plastic and are used to show where player should stand to hit ball from tee. They are usually made in three standard colors, red white and blue, that are used to show the three positions from which to tee up and hit the ball, depending on players ability.

These plain markers that are differentiated only by color, are used on golf courses. However, they do not incorporate the two other important features of our multi-feature golf tee receptacle.

Prior art does not offer the golfer additional advantages as does our invention.

Prior art has great disadvantages because it has only one use, whereas our invention has multiple uses.

OBJECTS AND ADVANTAGES

Objects and advantages of the present invention are:

(a) to provide a multi-use golf course accessory that is designed specifically for use on any golf course;

(b) to provide a multi-use golf course accessory that is a receptacle for holding broken golf tees on the golf course. The main reason for this condition at present is that there is no place or vehicle to deposit broken tees.

(c) to provide a multi-use golf course accessory that indicates the flag location on the green;

(d) to provide a multi-use golf course accessory that denotes the three possible places where players may tee off (blue, championship tees; white, intermediate; red, novice tees.)

(e) to provide a multi-use golf course accessory that can be fabricated from plastic, styrene, nylon, wood, metal or paper.

(f) to provide a multi-use golf course accessory that is available in three colors with options of adding other colors for special tournaments.

(g) to provide a multi-use golf course accessory that is a labor-saving device to reduce the amount of time a golf course maintenance person must spend picking up broken tees by hand and disposing of them. Broken tees left on the ground in the teeing area can have a damaging effect on the blades of the grass-cutting mowers.

(h) to provide a multi-use golf course accessory that, because of the aforementioned labor saving properties, results in cleaner tee areas on the course, reduced maintenance costs and a longer life for the grass-cutting mowers.

(i) to provide a multi-use golf course accessory that provides golfer with location of flag on green (ex. front, middle or back of green).

(j) to provide a multi-use golf course accessory that will turned only when repositioned, because of the two long spikes in the bottom.

(k) to provide a multi-use golf course accessory that provides golfer with information on where to stand to tee up and hit the ball.

(l) to provide a multi-use golf course accessory that provides the golfer with three-sided identification of location of flag on green.

(m) to provide a multi-use golf course accessory that is removable and replaceable with another of the same item.

(n) to provide a multi-use golf course accessory that is removable and easy to empty by golf course maintenance crew.

(o) to provide a multi-use golf course accessory on whose fourth side can be a logo or insignia of a golf course, business, company or corporation for identification and marketing purposes.

(p) to provide a multi-use golf course accessory that can be made of disposable material such as paper, yet incorporating all the multi-use characteristics and uses of the invention. A disposable model could be used for corporation, business or special event-sponsored golf tournaments where a company logo or insignia needed to be on the equipment for a temporary use.

(q) to provide a multi-use golf course accessory that is usable in all climates and weather conditions.

Further objects and advantages are to provide a golf course accessory that can be positioned and used easily and conveniently, without damage to the turf or green, which is simple to use and easy to manufacture, which can be supplied in numbers that each and every course needs, and which obviates the need for an item that is limited to being a teeing marker. Still further objects and advantages will become apparent from a consideration at the ensuing description and drawings.

REFERENCE NUMERALS IN DRAWINGS

10—cone-shaped hole
12—First side, tee indicator
14—Second side, tee indicator
16—Third side, tee indicator
16B—Fourth side, tee indicator
18—First side, letter designation
20—Second side, letter designation
22—Third side, letter designation
24—Fourth side, logo or insignia designation
25—Ground pin
26—ground pin

DRAWING FIGURES

FIG. 1 shows an isometric view of invention.
FIG. 2 shows an isometric view of invention.
FIG. 3 shows a cross-section view of invention.

STATIC DESCRIPTION OF FIGURES

A typical embodiment of the golf tee indicator is illustrated in FIGS. 1, 2 and 3. The container has pin location markers on three sides which are made from a plastic material, wood or other suitable products, or are die cut into the plastic product. The tee container can be made of many materials such as polyethylene, polypropylene, vinyl, nylon, rubber, various impregnated or laminated fibrous materials, various plasticized materials, cardboard, paper, etc. At the top of the tee indicator is a cone-shaped opening 10 extending down the middle of the indicator. This opening cuts through the bottom of the indicator allowing for drainage of water that may accumulate. This cone-shaped opening holds the broken tees.

Letter designations on the front and three sides 18, 20, 22, and 24 adhere to the tee container and be done by several proceeses, otheres not to be excluded. They are by a special glue, die cut into the container, or injection molded.

The marker designations on the front and sides serve an important purpose. When the position of the flag on the green is changed, the position of the tee indicator will change. When the flag is to the front of the green, the F (indicating front) first side letter designation will face the golfer on the tee. When the flag is to the middle of the green, the M (indicating middle) will face the golfer on the tee. When the flag is on the rear of the green, the R (indicating rear) third side letter designation will face the golfer on the tee. The tee indicator's cone-shaped area is used to hold broken tees deposited by golfers.

Ground pins 25, 26 hold the tee indicator in the ground on the fairway. The indicator can be removed from the ground, emptied of broken tees, then put back into the ground.

The ground pins allow for easy removal and repositioning in the ground of the tee indicator.

The base of the indicator is approximately four inches by four inches, and the height is six inches. The indicator can be manufactured in any configuration of sizes and is not limited to these dimensions.

The indicator will be fabricated in three colors, red, blue and white. All fabricated indicators will be the same except for the difference in color. Each will have a cone-shaped hole, first, second and third side letter designations, a fourth side for logos or symbols, and ground pins. The letter designations on the side may be the same color as the indicator or they may be a different color.

The color red will be the designation on the tee indicator placed where novice, or lighter weight golfers tee off, usually at the front of the teeing area, closer to the green. The color white will be the designation on the tee indicator placed in the middle of the teeing area for the average golfer. The color blue will be the designation on the tee indicator placed to the rear of the teeing area, for the expert golfer or professional golfer.

From the description above, a number of advantages of this tee indicator become evident:

The cone-shaped interior of the indicator will hold broken tees which are now strewn on the course, making additional work for the ground crew and contributing to the damage of the lawn mower blades.

The designations on the three sides of the container will indicate to the golfer the location of the flag on the green, thereby giving valuable information on how the hole should be played.

The colors of the indicators will show the golfer where to tee off, depending on his or her golfing ability.

The ease of cleaning and emptying the indicator will be expedited by the design of the indicator with ground pins.

The two ground pins will asure that the indicator is not accidentally turned as might happen with one ground pin. Indicators must be lifted out of the ground to be turned.

OPERATIONAL DESCRIPTION OF FIGURES

The tee indicator is designed to be used at each tee on a golf course. On each tee, six indicators would be used, designating the limits of the teeing areas and location of flag on green and as a receptacle for broken tees. There would be two red, two white and two blue to designate where the golfer must stand to tee off.

The tee indicator can be removed for easy emptying, cleaning or replacement.

The tee indicator can be rotated to show where the pin and flag are on the green, front, middle or rear.

The indicators can be fabricated from inexpensive materials or more costly materials, depending on the needs of the course. The indicators can be used at private, public and municipal courses and courses of any other designation or size.

SUMMARY, RAMIFACATIONS AND SCOPE

Thus the reader will see that the tee indicator of the invention provides a reliable and economical device which can be used on any golf course or any size.

The tee indicator has the advantages:

(a) to provide a multi-use golf course accessory that is designed specifically for use on any golf course;

(b) to provide a multi-use golf course accessory that is a receptacle for holding broken golf tees on the golf course;

(c) to provide a multi-use golf course accessory that indicates flag location on the green;

(d) to provide a multi-use golf course accessory that denotes the three possible places where players may tee off.

ADDITIONAL REFERENCES

Although the description above contains many specificities, these should not be construed as limiting the scope of the invention but as merely providing illustrations of some of the presently preferred embodiments of this invention. For example, the tee indicator can have other shapes, such as circular, oval, trapezoidal, triangular, etc. The cone-shaped part can have other shapes.

BROADENING PARAGRAPH

Thus the scope of the invention should be determined by the appended claims and their legal equivalents, rather than by the examples given.

I claim:

1. A golf tee marker and receptacle comprising an elongated body structure having flat and parallel top and bottom surfaces and a plurality of rectangular sides with indicia elements formed on said sides, said body structure including a cone shaped internal cavity forming circular openings in said top and bottom surfaces with a larger circular opening being formed in said top surface, and a multiple of ground engaging pins projecting from said body structure for positioning said body at variable locations on a golf course tee area.

2. A golf tee marker and receptacle comprising a body structure having top and bottom surfaces and at least three sides with indicia elements formed on said sides, said body structure including a cavity formed internally thereof with an open end of said cavity located in said top surface, said top and bottom surfaces being flat and parallel and said internal cavity being cone shaped and forming circular openings therein with a larger circular opening formed in said top surface than in said bottom surface, and at least one ground engaging pin secured to said body structure for positioning said body at variable locations on a golf course tee area.

3. The marker of claim 2 wherein said body is formed with a multiple of ground engaging pins projecting from the lower surface of said body.

4. The marker of claim 2 wherein the sides of said body are rectangular.

* * * * *